US010071873B2

(12) United States Patent
Allen, Jr. et al.

(10) Patent No.: US 10,071,873 B2
(45) Date of Patent: Sep. 11, 2018

(54) CONVEYOR HAVING OPPOSED UPPER AND LOWER DECKS

(71) Applicant: A. G. Stacker Inc., Weyers Cave, VA (US)

(72) Inventors: Clarence C. Allen, Jr., Mt. Crawford, VA (US); Kevin G. Gorby, Harrisonburg, VA (US); Micah C. Sundstrom, Staunton, VA (US)

(73) Assignee: A.G. STACKER INC., WEYERS CAVE, VA (US)

( * ) Notice: Subject to any disclaimer, the term of this patent is extended or adjusted under 35 U.S.C. 154(b) by 0 days.

(21) Appl. No.: 15/783,719

(22) Filed: Oct. 13, 2017

(65) Prior Publication Data

US 2018/0105381 A1 Apr. 19, 2018

Related U.S. Application Data

(60) Provisional application No. 62/408,633, filed on Oct. 14, 2016.

(51) Int. Cl.

| | |
|---|---|
| ***B65H 29/12*** | (2006.01) |
| ***B65H 29/14*** | (2006.01) |
| ***B65H 31/02*** | (2006.01) |
| ***B65H 37/00*** | (2006.01) |

(52) U.S. Cl.

CPC ..... *B65H 29/14* (2013.01); *B65H 29/12* (2013.01); *B65H 31/02* (2013.01); *B65H 37/00* (2013.01); *B65H 2301/121* (2013.01); *B65H 2301/152* (2013.01); *B65H 2406/36625* (2013.01); *B65H 2801/42* (2013.01)

(58) Field of Classification Search

CPC ..... B65H 5/025; B65H 29/12; B65H 29/14; B65H 31/02; B65H 37/00

See application file for complete search history.

(56) References Cited

U.S. PATENT DOCUMENTS

| | | | | | |
|---|---|---|---|---|---|
| 5,163,672 | A | * | 11/1992 | Mennie | B65H 29/12 271/187 |
| 5,244,197 | A | * | 9/1993 | Helmstadter | B65H 5/025 271/117 |
| 5,685,539 | A | * | 11/1997 | Janatka | B65H 5/025 198/836.1 |
| 5,697,880 | A | * | 12/1997 | Auerbach | B65H 29/12 198/369.2 |

* cited by examiner

*Primary Examiner* — David H Bollinger

(74) *Attorney, Agent, or Firm* — J-Tek Law PLLC; Jeffrey D. Tekanic; Scott T. Wakeman

(57) ABSTRACT

A conveyor includes a first conveyor deck having a first plurality of contact elements, each having a contact surface movable around a closed path from a contact region to a non-contact region, the first contact regions lying in a plane or being bounded by the plane and a second conveyor deck having a second plurality of contact elements, each having a contact surface movable around a closed path from a contact region to a non-contact region, these contact regions lying in a second plane or being bounded by the second plane. The transport path of the conveyor is defined by the contact surfaces of the first and second contact elements in the contact regions, and the first plurality of contact elements are belts and the second plurality of contact elements are wheels.

18 Claims, 5 Drawing Sheets

CONVEYOR HAVING OPPOSED UPPER AND LOWER DECKS

CROSS-REFERENCE TO RELATED APPLICATIONS

The present application claims the benefit of U.S. Provisional Patent Application No. 62/408,633 filed Oct. 14, 2016, the contents of which are hereby incorporated by reference.

TECHNOLOGICAL FIELD

The present disclosure is directed to a conveyor having opposed upper and lower decks for transporting a stream of sheets, and, more specifically, toward a conveyor having opposed upper and lower conveyor decks, one of which includes a plurality of belts for contacting the sheets and one of which includes a plurality of wheels for contacting the sheets.

BACKGROUND

A conventional stacking apparatus 10 is illustrated in FIG. 1. The stacking apparatus 10 is configured for use adjacent to a rotary die cut machine 12 which cuts blanks (not illustrated) from sheets of material, for example, corrugated paperboard. The stacking apparatus 10 includes a receiving or "layboy" section 14 that receives the blanks from the die cut machine 12 and discharges them onto a transfer conveyor 16. The transfer conveyor 16 carries the blanks to an inclined main conveyor 18, and the blanks travel along the main conveyor 18 to its downstream end 20 where they are discharged into a accumulator 22 (sometimes referred to as a "hopper").

Die cut machines produce a certain amount of scrap material during operation which consists mainly of the portions of the input material that do not become part of a finished blank. In addition, each blank may include slots or through-openings. The material cut from the blanks to form these slots and through-openings also constitutes scrap.

Most scrap material produced by the die cut machine drops beneath or immediately in front of the die cut machine as it operates. However, it is not uncommon for a material sheet to be cut incompletely so that portions of the sheet that were supposed to be removed wind up traveling into the layboy with the blank. Excessive scrap in the transport path between the layboy section and the final stack of blanks may adversely affect the transport of the blanks. That is, the scrap may interfere with the alignment of the blanks or lead to jams. Alternately, if the scrap is carried all the way through the stacker and into the final stack of blanks, the blanks in the stack will have gaps therebetween where the scrap material is present thus resulting in a crooked, or oversized or non-uniform stack of blanks. Some scrap may even end up inside a finished box formed from the cut blanks; this is generally undesirable to most end customers and must be completely avoided in some applications, such as boxes for use to package food.

It is therefore known to provide various scrap removal devices in a layboy. These may comprise, for example, brushes that gently contact a top and/or bottom surface of the moving blanks to dislodge the scrap. It would be desirable to further reduce the presence of scrap in a stream of sheets being conveyed in a sheet stacking system.

SUMMARY

It may sometimes be desirable to add an additional conveyor section to a stacking system, between the layboy section 14 and the transfer conveyor 16 or between the transfer conveyor 16 and the main conveyor 18, for example. This additional section may be, for example, a section configured to divert selected sheets from a stream of sheets as described in co-pending application Ser. No. 15/783,630, filed concurrently herewith, entitled "Diverter Conveyor," which application is hereby incorporated by reference, or a section having brushes or a fan for removing scrap and dust from the stream of sheets as described in co-pending application Ser. No. 15/783,679, filed concurrently herewith, entitled "Conveyor Section Having A Fan For Dust Removal," and assigned to the assignee of the present application, which application is hereby incorporated by reference.

Conveyors having upper and lower decks that face each other and define between them a transport path for a single stream of sheets or multiple parallel streams of sheets are known. These conveyors either have belts on the upper deck and belts on the lower deck, which belts have contact surfaces that define the transport path, or have wheels on the upper and lower decks, which wheels define the transport paths. However, in some applications, such as those discussed herein, it may be advantageous to provide one of the opposed upper and lower conveyor decks with belts and the other with wheels.

Conveyor types are described herein on the basis of the structure that makes contact with a sheet of material being transported along a transport path and that defines one side of the transport path. Therefore, even though the belts of a conveyor having belts are supported by pulleys, which may be considered a type of wheel, a conveyor having belts is not a conveyor in which the wheels are intended to contact the sheets being transported. Conveyor decks discussed herein that have wheels for forming a contact surface for transporting sheets are not conveyors having belts. This is true even if a small portion of one or more of the pulleys that support the belts make contact with the sheets being transported.

A first aspect of the present disclosure therefore comprises a conveyor configured to transport sheets along a transport path from an input end to a discharge end. The conveyor includes a first conveyor deck comprising a first plurality of contact elements, each contact element of the first plurality of contact elements having a contact surface movable around a first closed path from a first contact region to a first non-contact region, the first contact regions lying in a first plane or being bounded by the first plane. The conveyor also includes a second conveyor deck comprising a second plurality of contact elements, each contact element of the second plurality of contact elements having a contact surface movable around a second closed path from a second contact region to a second non-contact region, the second contact regions lying in a second plane or being bounded by the second plane. The transport path of the conveyor is defined by the contact surfaces of the first plurality of contact elements in the first contact region and the contact surfaces of the second plurality of contact elements in the second contact region, and the conveyor is configured such that the sheets make direct contact with the contact surfaces of the first plurality of contact elements and make direct contact with the contact surfaces of the second plurality of contact elements when the sheets move along the transport path. The first plurality of contact elements are belts and the second plurality of contact elements are wheels.

DETAILED DESCRIPTION

Figure 2:
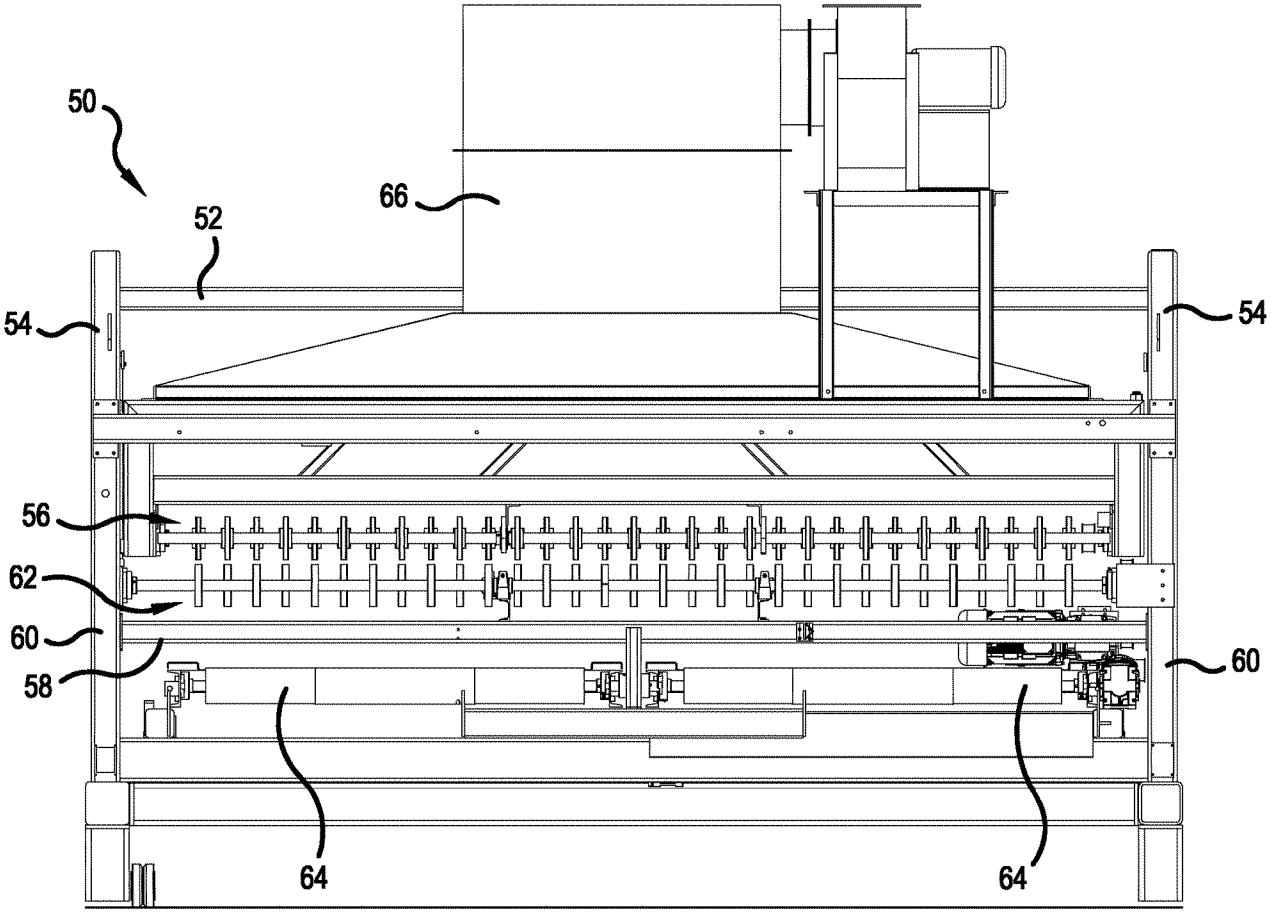
FIG. 2 is front elevational view of a conveyor section having upper and lower conveyor decks according to the present disclosure looking in a sheet transport direction.

Referring now to the drawings, wherein the showings are for the purpose of illustrating embodiments of the disclosure only and not for the purpose of limiting same, FIG. 2 shows a conveyor section 50 according to the present disclosure that includes an upper frame 52 having four upper vertical supports 54 supporting an upper conveyor deck 56 and a lower frame 58 having four lower vertical supports 60 supporting a lower conveyor deck 62. At least one, and preferably all of the four lower vertical supports 60, includes a drive (not illustrated), e.g., a screw drive, a hydraulic cylinder, etc. connected to the four upper vertical supports 54 for raising and lowering the upper frame 52 relative to the lower frame 58 for adjusting a vertical dimension of a sheet transport path between contact elements of the upper conveyor deck 56 and the lower conveyor deck 62. First and second scrap removal conveyors 64 are mounted on the lower frame 58 for carrying scrap that falls from sheets being transported toward a collection point at one end of the conveyor section 50. A dust removal vacuum system 66, which may include suitable dust filters, is supported on the upper frame 52.

Figure 3:
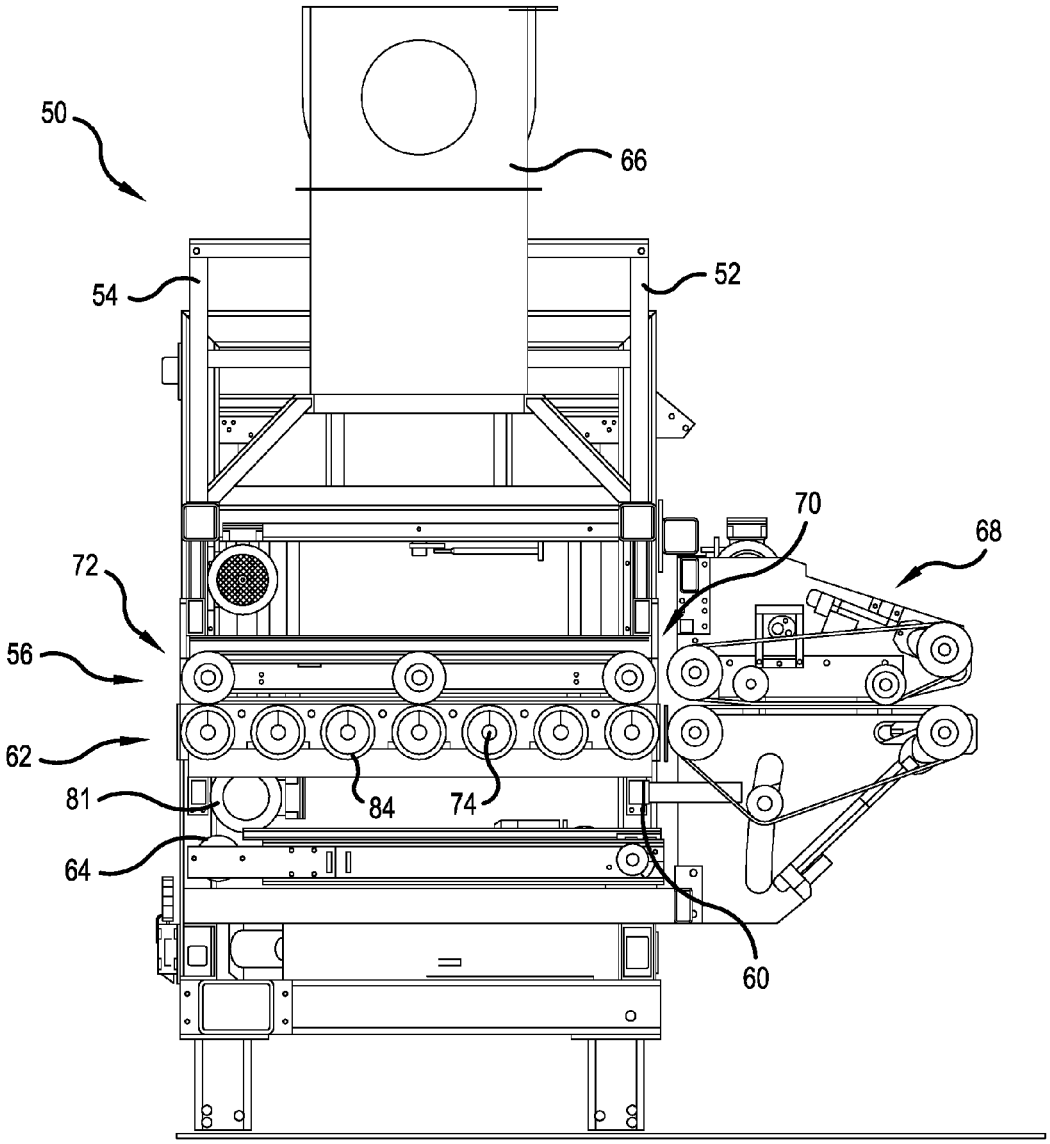
FIG. 3 is a side elevational view of the conveyor section of FIG. 2 looking perpendicular to the sheet transport direction.

FIG. 3 shows the conveyor section 50 from the left side with a layboy conveyor 68 mounted at the upstream end 70 of the conveyor section 50. The conveyor section 50 also includes a downstream end 72, the terms "upstream" and "downstream" referring to the intended direction of sheet travel through the conveyor section 50. The terms "left" and "right" may also be used herein to refer to portions of the conveyor section from the perspective of a person looking at the conveyor section 50 in the downstream direction, from the point of view of FIG. 2. In addition, the vertical direction in the Figures may be referred to herein as a "first" direction, the sheet travel direction, right to left in FIG. 3, may be referred to as a "second" direction, and the direction transverse to the second direction, from left to right in FIG. 2, may be referred to as a "third" direction.

Figure 4:
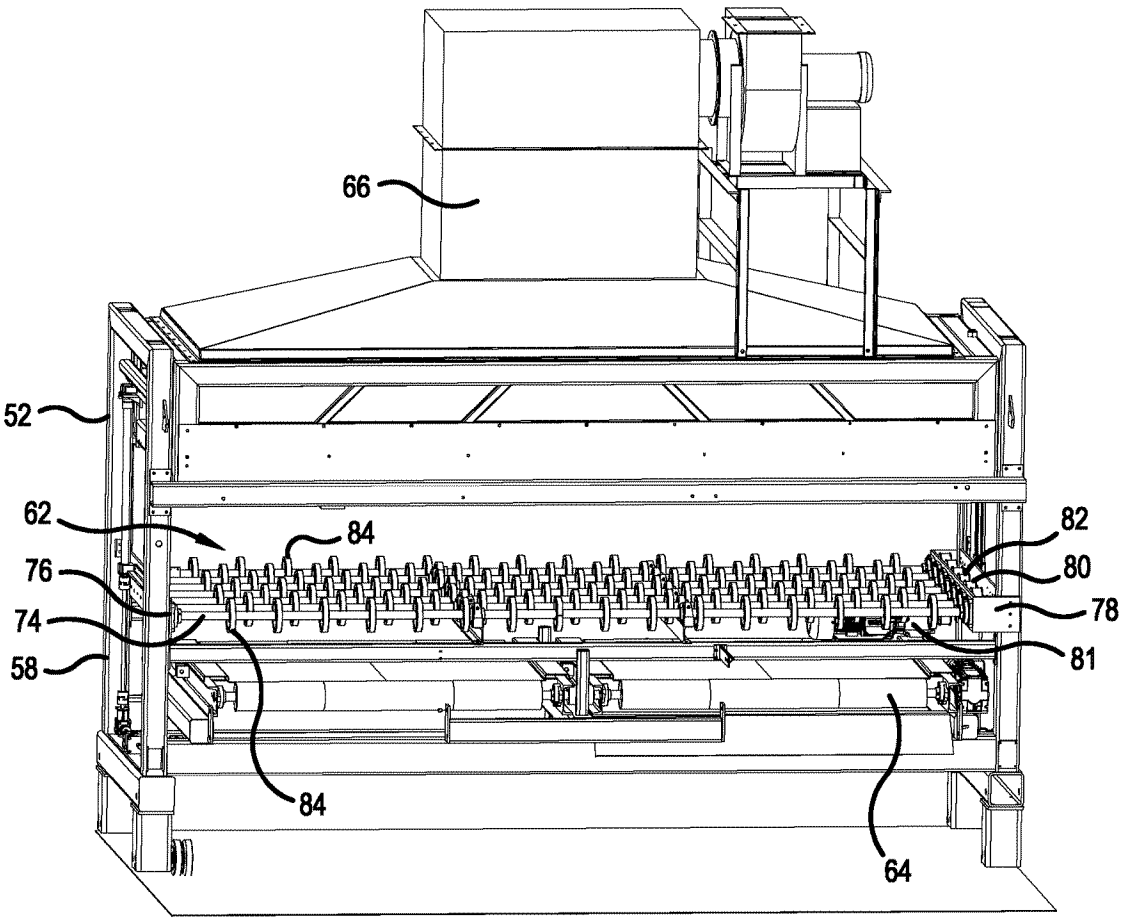
FIG. 4 is perspective view of the conveyor section of FIG. 2 with the upper deck removed for illustration purposes and looking down at the top of the lower conveyor deck.

In FIG. 4, the upper conveyor deck 56 has been removed for illustration purposes so that the lower conveyor deck 62 can more easily be seen. The lower conveyor deck 62 includes a plurality of transverse support shafts 74 that are rotatably mounted in a first support 76 at the left side of the conveyor section 50 and in a second support 78 at the right side of the conveyor section 50. End portions 80 of the support shafts 74 are operably connected to a drive 81 and interconnected by suitable drive belts or drive chains 82 so that all the support shafts 74 rotate in unison. The drive belts or drive chains 82 are located inside the second support 78 and do not contact sheets during sheet transport.

Each of the support shafts 74 includes a plurality of wheels 84. The wheels 84 are fixed against rotation relative to the support shafts 74 and therefore rotate with the support shafts 74. The wheels 84 may be discrete elements that are selectably securable to the support shafts 74, using screws or clamps (not illustrated) so that the number and location of the wheels 84 on the shafts 74 can be adjusted. Alternately, the wheels 64 may be integrally formed with the shafts 74 and thus comprise portions of the shafts 74 that have greater diameters. In other words, each shaft 74 may comprise first portions having a small diameter and second portions having a large diameter, the large diameter portions forming the wheels 84.

The wheels 84 on each of the shafts 74 are evenly spaced in a transverse (third) direction, that is, a direction transverse to the sheet travel direction. However, counting the shafts from front to back in the view of FIG. 4 with the front-most shaft 74 being the first shaft 74, the wheels 84 on the odd numbered shafts are offset in the third direction from the wheels 84 on the even-numbered shafts. The wheels on all the odd-numbered shafts 74 are mutually aligned in the sheet travel (second) direction, and the wheels on the even-numbered shafts are mutually aligned in the sheet travel (second) direction. However, when viewed from the left side of the conveyor section 50, from the perspective of FIG. 3, for example, the wheels 84 of the even number shafts 74 overlap the wheels 84 of the odd numbered shafts 74 in the second direction. In other words, the diameter of each of the wheels 84 is greater than the distance between each pair of shafts 74 in the sheet travel (second) direction. Staggering the wheels 84 in this manner helps provide a suitable support surface for sheets being transported. The shafts 74 are mounted such that the tops of the wheels 84 lie substantially in a single plane and such that a sheet resting on the wheels 84 will be substantially horizontal and planar.

The wheels 84 are intended to make contact with sheets being transported, and the wheels 84 may therefore sometimes be referred to as "contact elements." The radially outer surfaces of the wheels 84 may be referred to as "contact surfaces" because they are intended to directly contact sheets being transported through the conveyor section 50. These outer surfaces may be knurled to increase friction between the wheels 84 and the sheets. The portions of the wheels 84 facing in the direction of the upper conveyor deck 56, which portions will directly contact sheets, are described as being located in "contact regions." These contract regions of the wheels 84 are the regions of essentially line-contact between the sheets and the wheels 84 (because the sheets are not perfectly rigid, the area of contact is likely to be a small angular portion of the wheels 84 rather than a line). The contact regions therefore lie in a plane or are bounded by a plane, the plane representing the plane of a hypothetical perfectly rigid sheet resting on the surfaces of the wheels 84. Therefore, as the wheels 84 rotate, a given point on the surface of each wheel 84 will rotate into and out of the contact region.

Figure 5:
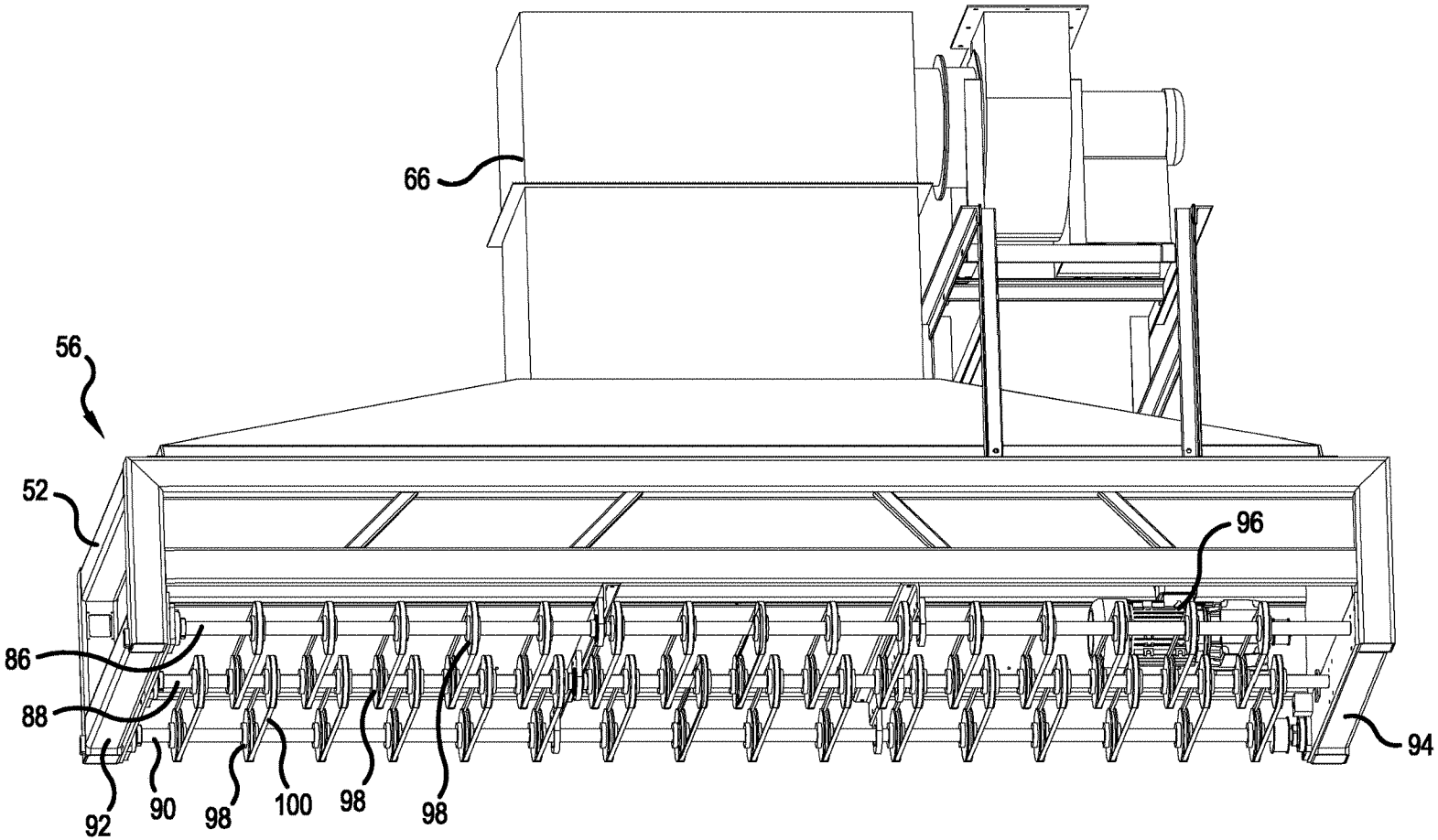
FIG. 5 is a perspective view of the upper conveyor deck of FIG. 2 separated from the conveyor section for illustration purposes.

Referring now to FIG. 5, the upper conveyor deck 56 includes a front transverse shaft 86, a middle transverse shaft 88 and a rear transverse shaft 90 which transverse shafts 86, 88, 90 extend from left to right or in the third direction from a first support 92 at the left side of the upper conveyor deck 56 to a second support 94 at the right side of the upper conveyor deck 56. The middle transverse shaft 88 is operably connected to a drive 96.

A plurality of pulleys 98 are mounted on the middle transverse shaft 88 and attached to the middle shaft 88 so that they rotate with the shaft when the shaft 88 is driven. The pulleys 98 are evenly spaced along the middle shaft 88 and may be described as being located at numbered locations 1, 2, 3 . . . 31 along the middle shaft 88. The front shaft 86 also includes a plurality of pulleys 98 that are fixed to the front shaft 86 for rotation therewith. The number of pulleys 98 on the front shaft 86 is approximately one half the number of the pulleys 98 on the middle shaft 88, and the pulleys 98 on the front shaft 86 are aligned with every other one of the pulleys 98 on the middle shaft 88. In FIG. 5, the pulleys 98 on the front shaft 86 are aligned with the even-numbered pulleys 98 on the middle shaft 88. The rear shaft 90 also includes a plurality of the pulleys 98 fixed to the rear shaft 90 for rotation therewith. The pulleys 98 on the rear shaft 90 are aligned with the odd-numbered pulleys 98 of the middle shaft 88. Belts 100 connect aligned pairs of pulleys 98 on the front shaft 86 and the middle shaft 88 and aligned pairs of the pulleys 98 on the middle shaft 88 and the rear shaft 90. Because the middle shaft 88 is driven by the drive 96 and the middle shaft 88 is connected to the front shaft 86 and to the rear shaft 90 by the belts 100, the front shaft 86 and the rear shaft 90 are driven by the rotation of the middle shaft 88.

The belts 100 of the upper conveyor deck 56 are examples of sheet contact elements that are configured to make direct contact with sheets traversing the conveyor section 50. The portions of the belts 100 that face the lower conveyor deck 62 form sheet contact surfaces. These sheet contact surfaces lie substantially in a plane parallel to the sheet transport direction. The portions of the belts 100 that face the lower conveyor deck 62 are located in a contact region, and all points on the belts 100 travel from contact regions (facing the lower conveyor deck 62) to non-contact regions (facing away from the lower conveyor deck 62) as the belts 100 rotate.

Figure 1:
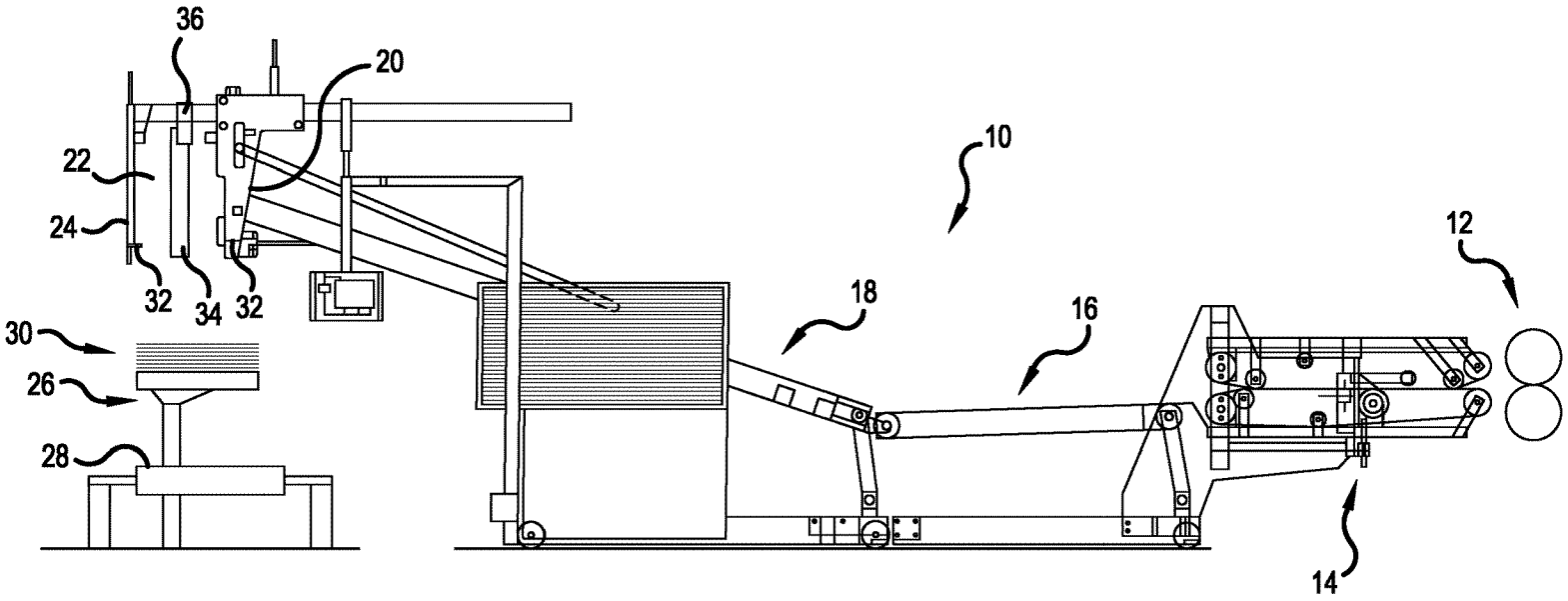
FIG.1 CONVENTIONAL ART
FIG. 1 is a side elevational view of a conventional stacking system that includes a layboy, a transfer conveyor and a main conveyor.

In operation, the upper conveyor deck 62 is positioned relative to the lower conveyor deck 56 so that the vertical separation between the plane in which the tops of the wheels 84 lie and the plane in which the bottoms of the belts 100 lie are separated by a desired distance based on the thickness of the sheets to be transported. In order to allow adequate control of the movement of the sheets without crushing or damaging the sheets during transport, the vertical separation will be approximately equal to the thickness of the sheets being transported. The sheets will exit the layboy conveyor 68 and enter a nip at the upstream end 70 of the conveyor section 50, which nip is defined by the belts 100 of the upper conveyor section 56 and the wheels 84 of the lower conveyor section 62. The lower conveyor deck drive 81 and the upper conveyor deck drive 96 are coordinated so that the belts 100 travel at the same speed as the tops of the wheels 84, and this pulls the sheets along the conveyor section 50 from the upstream end 70 to the downstream end 72 and ejects the sheets to a downstream conveyor (not illustrated) which may comprise the main conveyor 18 of a stacking system as illustrated in FIG. 1.

In many cases, belts provide a greater degree of control over the movement of sheets in a conveyor because a relatively large surface area of the belts remains in contact with the sheets as they move along a conveyor section. At the same time, this greater area of contact may hold scrap against the sheets and prevent the scrap from being removed from the sheets before they are stacked. The inventors have found that using wheels 84 on the lower conveyor deck 62 makes it easier for scrap to fall from the sheets and out of the sheet transport path (onto the scrap removal conveyors 64, for example) than if belts were used on both the upper and lower conveyor decks. That is, all lower surfaces of the sheets are free from roller or wheel contact at some time as the sheets traverse the conveyor section 50. At the same time, the use of belts 100 on the upper conveyor deck 56 provides adequate control over the movement of the sheets. And, because the belts 100 are staggered such that no individual belt 100 extends all the way from the upstream end 70 to the downstream end 72 of the conveyor section 50, all upper surfaces of the sheets are free from belt contact at some point as they traverse the conveyor section 50. This arrangement, when used with brushes, blowers, vacuums or other devices for removing scrap from sheets, has been found to improve the scrap removal process.

The present invention has been described herein in terms of a preferred embodiment. Additions and modifications to this embodiment will become apparent to persons of ordinary skill in the art upon a reading of the foregoing description. It is intended that all such modifications and additions form a part of the present invention to the extent they fall within the scope of the several claims appended hereto.

What is claimed is:

1. A conveyor configured to transport sheets along a transport path from an input end to a discharge end, the conveyor comprising:

a first conveyor deck comprising a first plurality of contact elements, each contact element of the first plurality of contact elements having a contact surface movable around a first closed path from a first contact region to a first non-contact region, the first contact regions lying in a first plane or being bounded by the first plane;

a second conveyor deck comprising a second plurality of contact elements, each contact element of the second plurality of contact elements having a contact surface movable around a second closed path from a second contact region to a second non-contact region, the second contact regions lying in a second plane or being bounded by the second plane;

wherein the transport path of the conveyor is defined by the contact surfaces of the first plurality of contact elements in the first contact region and the contact surfaces of the second plurality of contact elements in the second contact region, wherein the conveyor is configured such that the sheets make direct contact with the contact surfaces of the first plurality of contact elements and make direct contact with the contact surfaces of the second plurality of contact elements when the sheets move along the transport path, wherein the first plurality of contact elements are belts and the second plurality of contact elements are wheels, and wherein a width of the transport path is adjustable by moving the first conveyor deck relative to the second conveyor deck.

2. The conveyor according to claim 1, wherein the first conveyor deck is located above the second conveyor deck and above the transport path.

3. The conveyor according to claim 1, wherein a first direction is perpendicular to the first plane, wherein the belts each have a length in a second direction and a width in a third direction perpendicular to the second direction, the second and third directions being parallel to the first plane, and wherein the wheels each have an axis of rotation extending in the third direction.

4. The conveyor according to claim 3, wherein the first plane is spaced from the second plane in the first direction.

5. The conveyor according to claim 3, wherein the belts of the plurality of belts are spaced from each other in the third direction by a plurality of gaps.

6. The conveyor according to claim 3, wherein at least two belts of the plurality of belts are aligned in the third direction with at least two wheels of the plurality of wheels.

7. The conveyor according to claim 3, wherein the belts of the plurality of belts are located entirely to a first side of the second plane and the wheels of the plurality of wheels are located entirely to a first side of the first plane.

8. The conveyor according to claim 1, wherein the contact surfaces of the belts face the second plane.

9. A conveyor configured to transport sheets along a transport path from an input end to a discharge end, the conveyor comprising:

a first conveyor deck comprising a first plurality of contact elements, each contact element of the first plurality of contact elements having a contact surface movable around a first closed path from a first contact region to a first non-contact region, the first contact regions lying in a first plane or being bounded by the first plane; and a second conveyor deck comprising a second plurality of contact elements, each contact element of the second plurality of contact elements having a contact surface movable around a second closed path from a second contact region to a second non-contact region, the second contact regions lying in a second plane or being bounded by the second plane;

wherein the transport path of the conveyor is defined by the contact surfaces of the first plurality of contact elements in the first contact region and the contact surfaces of the second plurality of contact elements in the second contact region, wherein the conveyor is configured such that the sheets make direct contact with the contact surfaces of the first plurality of contact elements and make direct contact with the contact surfaces of the second plurality of contact elements when the sheets move along the transport path, wherein the first plurality of contact elements are belts and the second plurality of contact elements are wheels, wherein a first direction is perpendicular to the first plane, wherein the belts each have a length in a second direction and a width in a third direction perpendicular to the second direction, the second and third directions being parallel to the first plane, wherein the wheels each have an axis of rotation extending in the third direction, wherein the belts of the plurality of belts are spaced from each other in the third direction by a plurality of gaps, wherein the wheels of the plurality of wheels are mounted on axles extending in the third direction, wherein a first set of the wheels of the plurality of wheels is mounted on a first axle extending in the third direction, the wheels of the first set of wheels being spaced apart in the third direction, wherein a second set of the plurality of wheels is mounted on a second axle extending in the third direction, the wheels of the second set of wheels being spaced apart in the third direction, wherein the first axle is spaced from the second axle in the second direction, and wherein the wheels on the first axle are offset in the third direction from the wheels on the second axle.

10. The conveyor according to claim 9, wherein the wheels on the first axle overlap the wheels on the second axle in the second direction.

11. The conveyor according to claim 10, wherein the upper conveyor deck includes a front axle, a middle axle and a rear axle, and wherein a first set of the plurality of belts encircles the middle axle and the front axle but not the rear axle and a second set of the plurality of belts encircle the middle axle and the rear axle but not the front axle.

12. The conveyor according to claim 9, wherein the wheels are fixed relative to the axles and the axles are rotatably supported by a frame of the conveyor.

13. The conveyor according to claim 9, wherein the wheels are formed integrally with the axles and comprise enlarged-diameter portions of the axles.

14. The conveyor according to claim 9, wherein a width of the transport path is adjustable by moving the first conveyor deck relative to the second conveyor deck.

15. A conveyor configured to transport sheets along a transport path from an input end to a discharge end, the conveyor comprising:

a first conveyor deck comprising a first plurality of contact elements, each contact element of the first plurality of contact elements having a contact surface movable around a first closed path from a first contact region to a first non-contact region, the first contact regions lying in a first plane or being bounded by the first plane; and a second conveyor deck comprising a second plurality of contact elements, each contact element of the second plurality of contact elements having a contact surface movable around a second closed path from a second contact region to a second non-contact region, the second contact regions lying in a second plane or being bounded by the second plane;

wherein the transport path of the conveyor is defined by the contact surfaces of the first plurality of contact elements in the first contact region and the contact surfaces of the second plurality of contact elements in the second contact region, wherein the conveyor is configured such that the sheets make direct contact with the contact surfaces of the first plurality of contact elements and make direct contact with the contact surfaces of the second plurality of contact elements when the sheets move along the transport path, wherein the first plurality of contact elements are belts and the second plurality of contact elements are wheels, wherein a first direction is perpendicular to the first plane, wherein the belts each have a length in a second direction and a width in a third direction perpendicular to the second direction, the second and third directions being parallel to the first plane, wherein the wheels each have an axis of rotation extending in the third direction, and wherein, the wheels of the plurality of wheels extend through the first plane.

16. A conveyor configured to transport sheets along a transport path from an input end to a discharge end, the conveyor comprising:

a first conveyor deck comprising a first plurality of contact elements, each contact element of the first plurality of contact elements having a contact surface movable around a first closed path from a first contact region to a first non-contact region, the first contact regions lying in a first plane or being bounded by the first plane; and a second conveyor deck comprising a second plurality of contact elements, each contact element of the second plurality of contact elements having a contact surface movable around a second closed path from a second contact region to a second non-contact region, the second contact regions lying in a second plane or being bounded by the second plane;

wherein the transport path of the conveyor is defined by the contact surfaces of the first plurality of contact elements in the first contact region and the contact surfaces of the second plurality of contact elements in the second contact region, wherein the conveyor is configured such that the sheets make direct contact with the contact surfaces of the first plurality of contact elements and make direct contact with the contact surfaces of the second plurality of contact elements when the sheets move along the transport path, wherein the first plurality of contact elements are belts and the second plurality of contact elements are wheels, wherein a first direction is perpendicular to the first plane, wherein the belts each have a length in a second direction and a width in a third direction perpendicular to the second direction, the second and third directions being parallel to the first plane, wherein the wheels each have an axis of rotation extending in the third direction, wherein the upper conveyor deck includes a front axle, a middle axle and a rear axle, and wherein a first set of the plurality of belts encircles the middle axle and the front axle but not the rear axle and a second set of the plurality of belts encircle the middle axle and the rear axle but not the front axle.

17. The conveyor according to claim 16, wherein the first set of the plurality of belts alternates with the second set of the plurality of belts in the third direction.

18. The conveyor according to claim 16, wherein a width of the transport path is adjustable by moving the first conveyor deck relative to the second conveyor deck.

* * * * *